United States Patent [19]

Smith

[11] 4,347,961

[45] Sep. 7, 1982

[54] RAPID ADVANCE LONG DWELL FEED MECHANISM FOR MULTIPLE SLIDE MACHINES

[76] Inventor: Frank G. Smith, 911 Alabama Ave., Ft. Lauderdale, Fla. 33312

[21] Appl. No.: 236,702

[22] Filed: Feb. 23, 1981

[51] Int. Cl.[3] ..... B65H 17/36

[52] U.S. Cl. ..... 226/158; 74/27

[58] Field of Search ..... 226/158, 159, 160, 161, 226/162, 163, 164, 165, 166, 167, 141; 74/27

[56] References Cited

U.S. PATENT DOCUMENTS

| | | | |
|---|---|---|---|
| 2,825,560 | 3/1958 | Danly | 226/161 |
| 3,038,646 | 6/1962 | Grimm | 226/158 |
| 3,937,379 | 2/1976 | Narwid | 226/150 |
| 3,963,161 | 6/1976 | Jerney | 226/159 |
| 4,315,586 | 2/1982 | Dolamore | 226/141 |

*Primary Examiner*—Edward J. McCarthy
*Attorney, Agent, or Firm*—Erwin M. Barnett

[57] ABSTRACT

A rotary power transfer component incorporated in the rotary to reciprocating motion conversion drive mechanism which operates the reciprocating feeder of a multiple slide machine increases the time available to the forming operation by correspondingly decreasing the feed time of the wire or ribbon stock during each cycle. The rotary power transfer component comprises a drive wheel and crank wheel mounted for respective eccentric rotation. The drive wheel, which is driven at a uniform rate of rotation synchronized to the forming operation of the machine, has an eccentric fixed pin which engages a radial slot in the crank wheel to thereby impart to the latter a synchronized cycle with varying speed of rotation within the cycle to be converted to a rapid advance feed stroke and a slow return stroke for the reciprocating drive of the feeder during which return stroke the forming operations are performed.

12 Claims, 8 Drawing Figures

FIG. 1
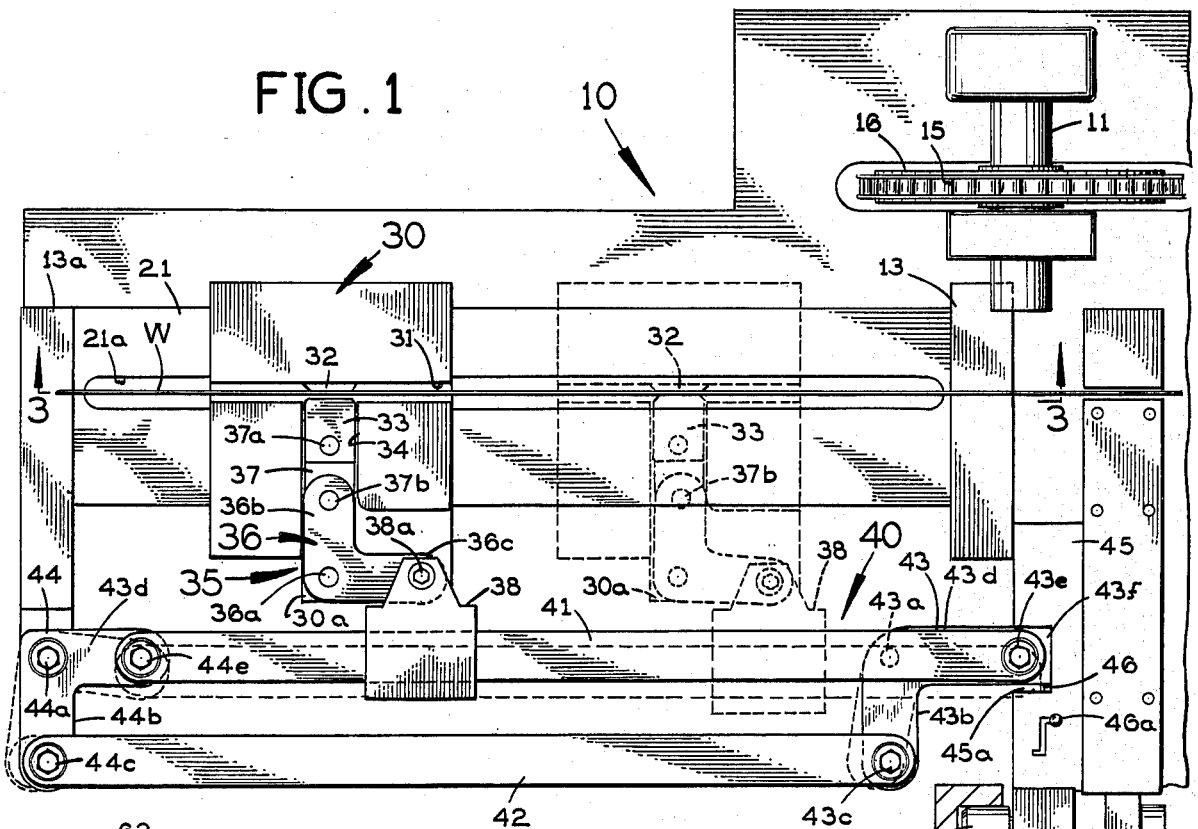
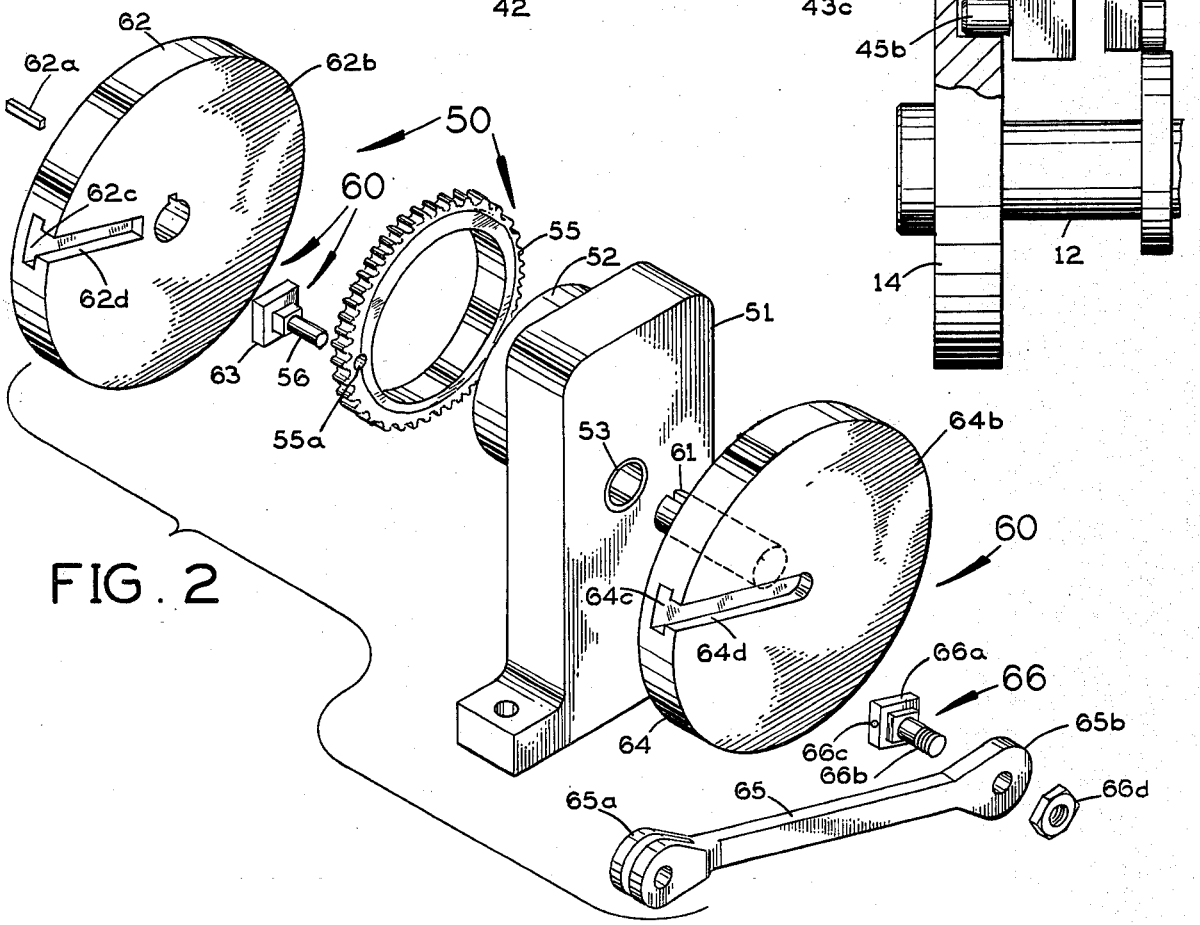
FIG. 2

RAPID ADVANCE LONG DWELL FEED MECHANISM FOR MULTIPLE SLIDE MACHINES

BACKGROUND OF THE INVENTION

1. Field of the Invention

This invention relates generally to drive mechanisms for converting rotary motion to reciprocating motion and more particularly to the conversion of a uniform speed rotary motion to a rapid advance stroke and slow return stroke of the reciprocating component and to the adaptation of such drive mechanisms to multiple slide machines used in forming metal wire or ribbon into a wide variety of products.

2. Description of the Prior Art

Multiple slide machines, also known as four-slide machines, provide the various basic motions required to form lengths of wire or ribbon into a variety of metal products in a wide range of sizes and configurations. The cycle of operation of these machines comprises the four general steps of feeding a predetermined length of wire into the forming mechanism, cutting the length from the supply reel, forming the cut length by operation of the slides and then ejecting the finished piece. Each revolution of the main drive shaft, which includes four component shafts mounted along the periphery of the rectangular bed of the machine, performs one complete cycle of operation through appropriate actuation of the slides and a rotary to reciprocating motion conversion drive mechanism operating a precision reciprocating wire or ribbon feeder which performs the measuring and feeding step. The feeder has a gripper which reciprocates along a straight track provided with adjustable abutment stops at each opposite end to limit the length of travel of the gripper to a close tolerance and hence provide for precise measurement of the wire being fed. The conventional rotary to reciprocating motion conversion drive mechanism heretofore provided in multiple slide machines requires the forward and return strokes of the gripper to be of equal time duration, the wire being gripped and advanced into the bed of the machine during the forward stroke while the slides are at rest in a dwell period of one half cycle. During the other half cycle the gripper releases the wire and returns while the cutting and forming operations are being performed by the slides.

The need for increasing the time in each cycle during which the slides are in operation by shortening the time interval of the feed stroke in order to achieve maximum output of the machine has long been recognized, particularly where the piece is formed from a relatively short length of wire or ribbon stock, such as $1\frac{1}{2}$ to 2 inches. One solution in prior use provides a rapid feed device which occupies one of the slide positions and hence reduces the forming capability of the machine to that of the three remaining slides. Another prior art device utilizes two rapid feed strokes for each cycle while increasing the forming operation time interval of each cycle. But this mechanical arrangement is utilized for relatively low output with upper limits of approximately 160 units per minute and where the length of wire required for each unit may approach 20 inches so that two short rapid feed strokes have advantages over one long stroke. The latter arrangement is not feasible for high speed machines capable of maximum output of 550 units per minute when forming such units from stock $1\frac{1}{2}$ to 2 inches in length.

SUMMARY OF THE INVENTION

Among the objects of the invention is to increase the output capacity of multiple slide machines and thereby reduce the unit cost of each piece produced by the machine, including those pieces formed from relatively short lengths of wire or ribbon stock, namely, $1\frac{1}{2}$ to 2 inches in length, and at production rates as high as 550 units per minute while maintaining tolerances to $\pm 0.0005$ inch. This increase in output shall be accomplished by reducing the dwell time of the slides, which time is required for feeding the stock into the bed of the machine and correspondingly increasing the time available for the operation of the slides during which time in each cycle the stock is formed by the slides into the configuration of the finished piece. The ratio of slide operating time in each cycle to the dwell time is increased from the conventional 1:1 to 2:1. In other words, the slide operating time interval is increased from $\frac{1}{2}$ cycle to $\frac{2}{3}$ cycle by a relatively inexpensive modification incorporated in the rotary to reciprocating motion conversion drive mechanism which operates the otherwise conventional feeder from the main drive shaft to deliver a fast forward feed stroke and a slow return stroke.

The invention features a rotary to reciprocating motion conversion drive mechanism interposed between the main drive shaft of the machine and the reciprocating wire gripper of a conventional wire feeder driven in timed relation with the multiple slides of the machine. A sprocket wheel driven at a uniform rate in a one to one rotation ratio by a chain from the main drive shaft of the machine serves as a drive wheel for the rotary to reciprocating conversion drive mechanism and is mounted for rotation on a first axis. A crank wheel assembly of the conversion drive mechanism has a radially extending slot formed in a first side surface thereof and is mounted for rotation on a second axis parallel to and spaced a predetermined distance from said first axis. A pitman arm is pivotally mounted at one end to an adjustable eccentric location on a second side surface of the crank wheel assembly, the other end of the pitman arm being connected to a linkage for reciprocating the wire gripper. A pin mounted eccentrically on the drive wheel projects into and slidingly engages the radial slot on the first side surface of the crank wheel assembly whereby the latter is driven in a one to one rotation ratio but at a variable rate of rotation with respect to the uniform rotation rate of the drive wheel. Utilizing this variable rate of rotation, the pitman arm advances the gripper during a rotation interval at a relatively high speed and returns the gripper during a rotation interval of relatively low speed. A cam means driven by the main drive shaft actuates the gripper to feed the wire during the high speed advance stroke.

BRIEF DESCRIPTION OF THE DRAWINGS

FIG. 1 is a fragmentary top plan view of the input end of a multiple slide machine embodying the invention showing the reciprocating wire gripper of the feeder with the coverplate removed to show interior structure, the gripper and the jaw actuating assembly in wire gripping position at the beginning of the forward stroke being shown in full lines and shown in broken lines in a wire release position during the return stroke.

FIG. 2 is an exploded perspective view of the rotary to reciprocating motion conversion drive mechanism embodying the invention shown in FIG. 4 removed from the machine to show features of construction.

DESCRIPTION OF THE PREFERRED EMBODIMENT

Figure 3:
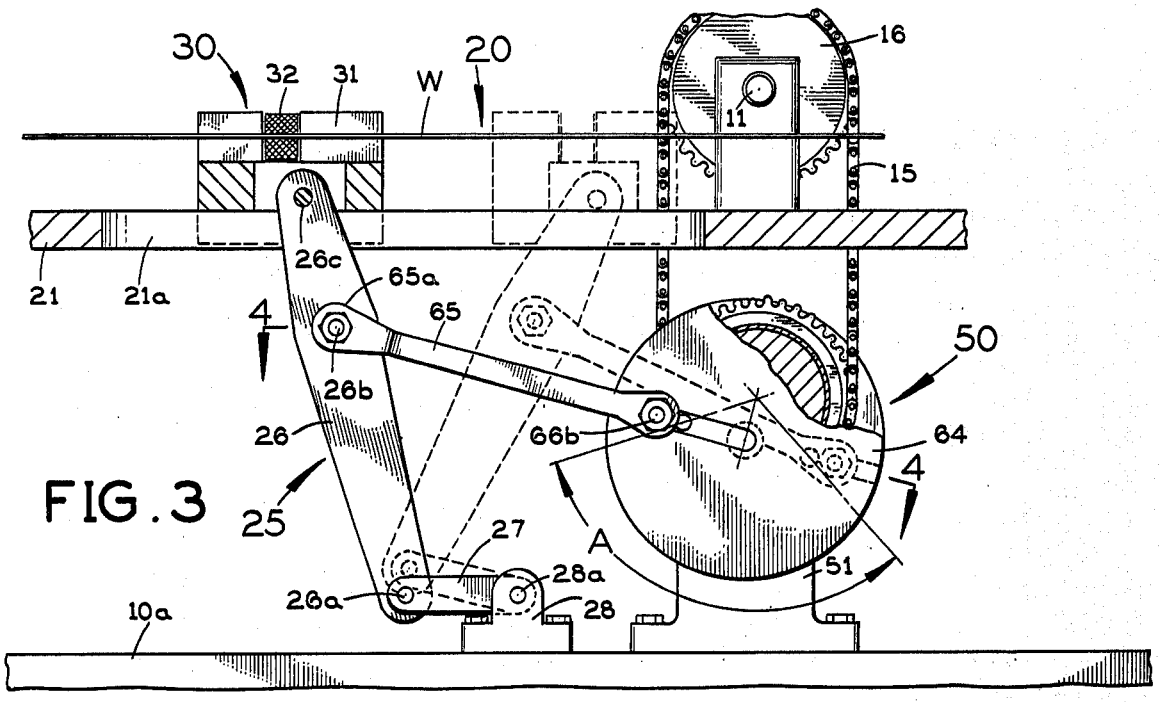
FIG. 3 is a vertical sectional view taken on line 3—3 in FIG. 1 showing the rotary to reciprocating motion conversion drive mechanism interposed between the main drive shaft and the reciprocating gripper of the feeder, the crank wheel and pitman arm being shown in full lines at the beginning of the forward, wire feeding stroke and in broken lines at the end of the stroke after the crank wheel rotates 180° driven by the rotation of the drive wheel through angle A shown at approximately 120°.
Figure 4:
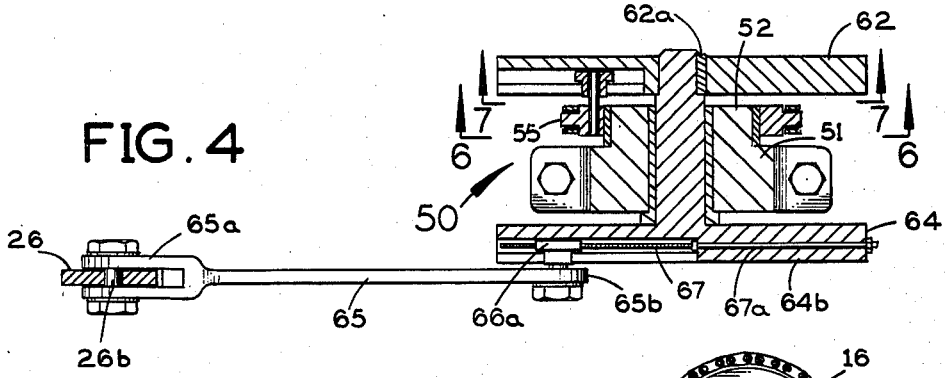
FIG. 4 is a sectional view taken on line 4—4 in FIG. 3 showing details of the rotary to reciprocating motion conversion drive mechanism embodying the invention.

Referring in detail to the drawings, 10 generally denotes a multiple slide machine of any conventional construction, the input end of which is shown in FIGS. 1, 3 and 4 to comprise a main drive shaft transverse section 11 and a longitudinal section 12, a feeder 20 and a rotary to reciprocating motion conversion drive mechanism 50 interposed between drive shaft section 11 and reciprocating gripper 30 of feeder 20.

Feeder 20, being of any well known construction, a version of which is herein shown and described only in such detail as deemed necessary for a clear understanding of the invention, may comprise a horizontally disposed track 21, a gripper 30, a gripper jaw actuator assembly 40 and a linkage 25 connecting gripper 30 with pitman arm 65 of drive mechanism 50 which reciprocates gripper 30 in a rapid forward and slow return stroke in accordance with the invention as hereinafter more fully described. Track 21 is suitably supported at opposite ends thereof by frame members 13 and 13*a* of machine 10 and is formed with a centralized longitudinal slot 21*a* through which the upper end of lever arm 26 of linkage 25 extends for connecting by a suitable pivot pin 26*c* to the underside of gripper 30. As seen in FIG. 3, linkage 25 includes the lever arm 26 which extends upwardly in a generally vertical direction to the pivotal engagement with gripper 30 from a lower end loosely attached to bottom plate 10*a* of machine 10 by short intermediate link 27 and pillow block 28 bolted to bottom plate 10*a*. The respective pivotal connections at the opposite ends of link 27, namely, pin 26*a* to the lower end of lever arm 26 and pin 28*a* to block 28, permit lever arm 26 to rise and lower thereby accommodating the reciprocating movement of gripper 30 along the straight line horizontal track 21 as lever arm 26 is rocked back and forth by pitman arm 65, the latter being pivotally connected at a forked driven end 65*a* thereof in knuckle joint fashion by pin 26*b* to a midportion of lever arm 26.

Gripper 30 has a width exceeding that of track 21 and is formed as a block with a longitudinal bottom channel for sliding engagement with track 21. The top cover plate being removed in the showing in the drawing, gripper 30 is seen to have a longitudinal centralized passageway 31 through which wire W, or a ribbon stock, extends, being fed, in the well understood manner, from a supply reel and through suitable roll straighteners (not shown), and includes a pair of jaws 32 and 33 projecting into passageway 31 at a midportion thereof for releasably grasping wire W passing therebetween. Jaw 32 is relatively fixed except for adjustability by a mounting means (not shown) for accommodating wire W, or ribbon stock, of different diameters or thicknesses. Jaw 33 is movable a relatively short predetermined distance toward and away from jaw 32 to provide the selective wire gripping action of feeder 20 under the control of cam 14 mounted on drive shaft section 12 through jaw actuator assembly 40 and expansion linkage 35 which comprises bell crank 36, intermediate link 37 and a sliding follower 38. A pin 36*a* pivotally mounts the center of bell crank 36 on a laterally extending ledge 30*a* of gripper 30 and positions one arm 36*b* to extend into a transverse slot 34 which communicates with longitudinal passageway 31, jaw 33 having the body portion thereof located as a snug fit in the inner end of slot with the wire engaging end portion thereof extending into passageway 31 opposite fixed jaw 32. Intermediate link 37 is pivotally connected at opposite ends thereof by pins 37*a* and 37*b* to jaw 33 and the end of bell crank arm 36*b*, respectively. Link 37 and arm 36*b* are both narrower in width than slot 34 permitting sufficient transverse movement therein for the operation of expansion linkage 35 as hereinafter described. Sliding follower 38 pivotally connects by pin 38*a* to the end of the other arm 36*c* of bell crank 36 and is formed with a channel on the underside thereof for sliding engagement on shift bar 41 of assembly 40.

Gripper jaw actuator assembly 40, likewise of well known construction, enables shift bar 41 thereof to move laterally toward and away from track 21 while maintaining a precise parallel relation therewith and thereby, through slide follower 38, control the position of bell crank 36 and in turn the action of movable jaw 33 during the reciprocating movement of gripper 30 along track 21. To this end, assembly 40 comprises a pair of bell cranks 43 and 44 mounted at centers thereof on frame members of machine 10 by pins 43*a* and 44*a*, respectively, to pivot in a horizontal plane. The laterally extending arms 43*b* and 44*b* of bell cranks 43 and 44 have pivot pins 43*c* and 44*c*, respectively, which connect to opposite ends of alignment bar 42. The other bell crank arms 43*d* and 44*d* pivotally connect by pins 43*e* and 44*e*, respectively, to opposite ends of shift bar 41 and support the latter thereon. Bell crank arm 43*d* has an end portion 43*f* extending beyond pivot pin 43*c* to engage cutout 45*a* in slide bar 45 which is mounted for movement perpendicular to the longitudinal axes of track 21, shift bar 41 and alignment bar 42 and extends toward drive shaft section 12 for actuation by face cam 14 through a roller 45*b* projecting therefrom.

To facilitate machine adjustments and setups, a capability for deactivating jaw actuator assembly 40, while slide bar 45 and gripper 30 continue to be reciprocated through rotating drive shaft sections 11 and 12, may be provided by sizing slide bar cutout 45*a* to permit bell crank end portion 43*f* to remain stationary during the full throw of slide bar 45. A latch-bolt type plunger 46 is mounted within slide bar 45 for selective extended or retracted positioning in cutout 45*a* by a finger grip 46*a* extending upwardly through a Z-shaped slot for manual positioning and locking plunger 46 in the well understood latch-bolt fashion. During the normal operation of machine 10, plunger 46 is extended into cutout 45*a* as shown in FIG. 1 so that bell crank end portion 43*f* moves with slide bar 45 actuating assembly 40.

Figure 6:
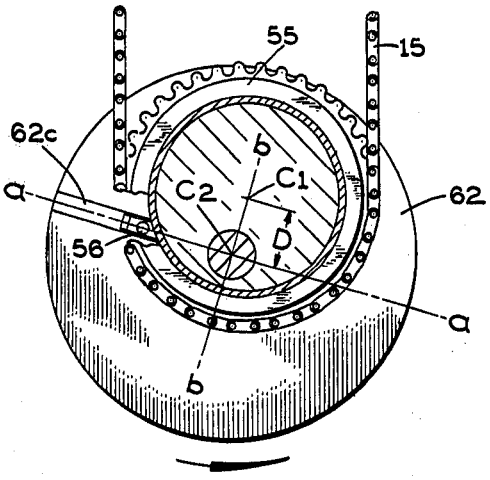
FIG. 6 is a sectional view taken on line 6—6 in FIG. 4, part of the drive wheel being broken away to show the connecting pin positioned on plane a—a.

The rotary to reciprocating motion conversion drive mechanism 50 embodying the invention is seen in FIGS. 2, 3 and 4 to generally comprise support bearing block 51 upstanding from and suitably anchored to machine bottom plate 10*a*, a sprocket wheel 55, crank wheel assembly 60 driven by sprocket wheel 55, and pitman arm 65. A stub shaft 52 of relatively large diameter extends from one side of bearing block 51 and an opening fitted with a bearing 53 extends through block 51 within the circumference of stub shaft 52, the axes of shaft 52 designated C1 and bearing 53 designated C2 being parallel but eccentrically offset by a predetermined distance D as indicated in FIG. 6. Sprocket wheel 55 is driven to rotate on stub shaft 52 by chain 15 through a companion sprocket wheel 16 mounted to turn with main drive shaft section 11. Sprocket wheel 55 is suitably provided in an eccentric fixed location with a pin 56 by which crank wheel assembly 60 is driven at a variable rate of rotation in accordance with the invention.

Figure 8:
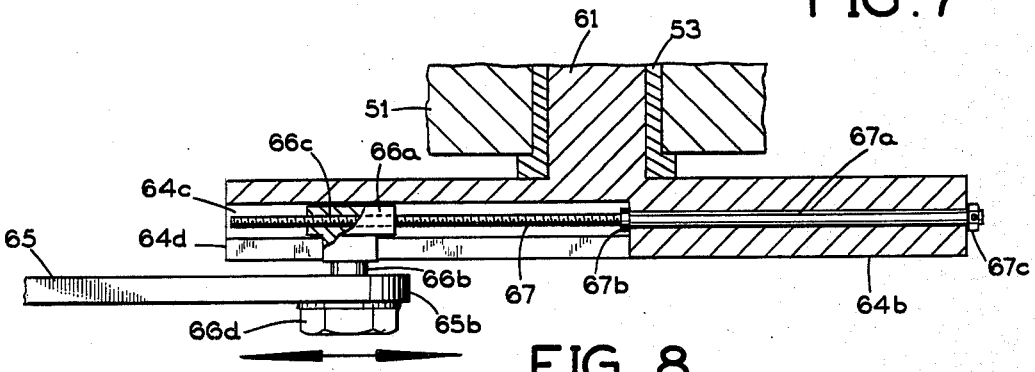
FIG. 8 is an enlarged fragmentary sectional view showing details of the adjustable connection between the pitman arm and the crank wheel shown in FIG. 4.

Crank wheel assembly 60 comprises a pair of wheels 62 and 64 both suitably mounted to turn with shaft 61 which is journaled at a midportion thereof in bearing 53. Whereas, both wheels may be keyed to the shaft, wheel 64 is shown permanently attached to one end of shaft 61 extending beyond block 51 and, at the opposite end of shaft 61 which extends beyond stub shaft 52, wheel 62 is shown removably mounted in close proximity to but free of contact with sprocket wheel 55 and is secured to shaft 61 against relative rotation by key 62*a*. A slider 63 is mounted for sliding movement along a radially extending trackway 62*c* formed in wheel 62 and having a slot 62*d* of reduced width which opens along side surface 62*b* facing sprocket wheel 55. As seen in FIGS. 2 and 4, pin 56 may be secured to project from slider 63 through slot 62*d* and engage an opening 55*a* in sprocket wheel 55. Wheel 64 may be fashioned as a crank wheel which is constructed, in any well known manner, with pitman arm length of throw adjustability which in turn provides the adjustability in the length of travel of gripper 30 along track 21 and determines the length of wire W being fed. To this end, wheel 64 is shown with a radially extending trackway 64*c* having a slot 64*d* of reduced width which opens along outwardly facing side surface 64*b*. A pivot pin assembly 66 is formed with a slider portion 66*a* located in trackway 64*c* for adjustable movement therealong and a pivot pin 66*b* extending from slider portion 66*a* through slot 64*d*, the eyelet end 65*b* of pitman arm 65 being pivotally mounted on pin 66*b* and suitably secured thereon, as by nut 66*d*. A threaded rod 67 (omitted from FIG. 2) extends longitudinally through trackway 64*c* and through a threaded transverse opening 66*c* in slider portion 66*a* providing means for selectively locating pivot pin assembly 66 along trackway 64*c*. As shown in FIG. 8, non-threaded end portion 67*a*, having interior flange 67*b* and securing nut 67*c*, rotatably mounts rod 67 in crank wheel 64, nut 67*c* being pinned to rod 67 for rotating the latter.

Figure 5:
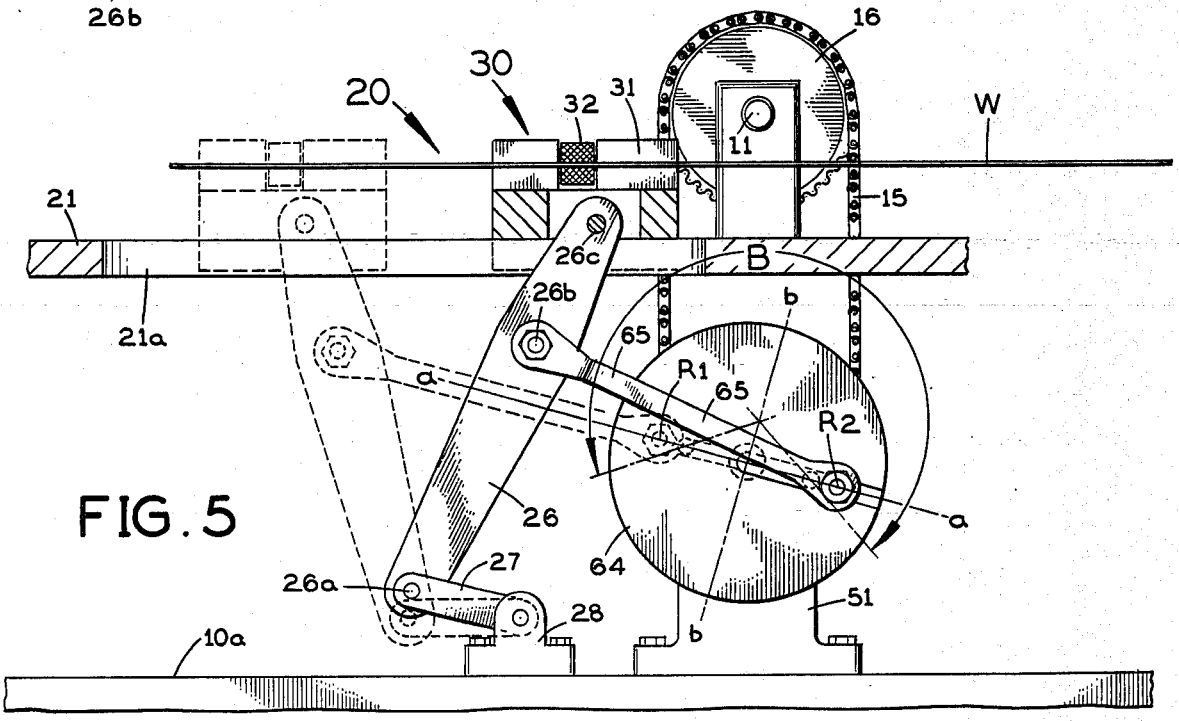
FIG. 5 is a sectional view similar to FIG. 3 but showing the crank wheel and pitman arm in full lines at the beginning of the return stroke of the gripper and in broken lines at the end of the stroke after the crank wheel has rotated a second 180° to complete the cycle being driven by the rotation of the drive wheel through angle B shown as approximately 240°.
Figure 7:
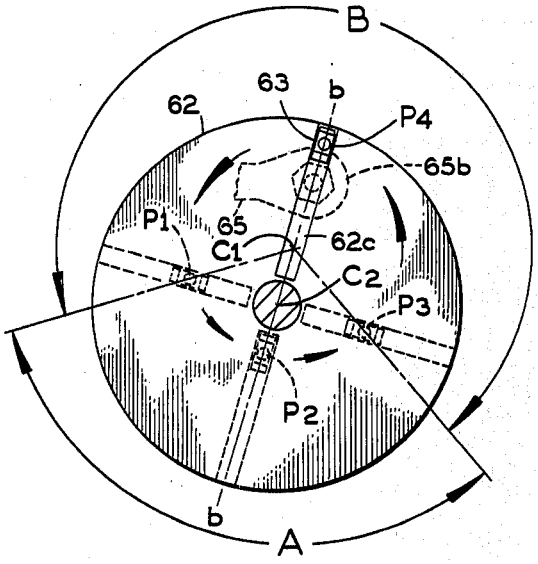
FIG. 7 is a sectional view taken on line 7—7 in FIG. 4 but with crank wheel assembly advanced 270° to a position in the middle of the return stroke locating the connecting pin at the maximum radial distance from the axis of rotation of the crank wheel assembly, the corresponding position of the pitman arm being superimposed in broken lines as are three other positions of the connecting pin defining the circular path of rotation thereof indicated by the arrows.

The operation of the rotary to reciprocating motion conversion drive mechanism 50 will be described prior to reviewing the overall operation of feeder 20. Referring to FIGS. 6 and 7, sprocket wheel 55 rotating on axis C1 is driven at a uniform rate in a one to one ratio of rotation by main drive shaft section 11, all the drive shaft sections of machine 10 being conventionally interconnected and driven in unison at a uniform rate of rotation and produce one complete piece with each single rotation. The plane a—a is perpendicular to axis b—b along which axes C1 and C2 are offset from each other by the distance D and coextends with axis C2 and hence extends diametrically through wheels 62 and 64 and also coextends with the longitudinal axis of pitman arm 65 when the latter is in the extended null position, that is, at the point of transition between the end of the return stroke and the beginning of the forward, feed stroke as indicated in full lines in FIG. 3. In driving crank wheel assembly 60, pin 56, being positioned at a fixed eccentric location on sprocket wheel 55 and revolving about axis C1, causes slider 63 to move along trackway 62*c* between a maximum radial distance from axis C2 when the circular path of pin 56 intersects axis b—b beyond axis C1 at point P4 and a minimum radial distance from axis C2 when the path again intersects axis b—b beyond axis C2 at point P2, as seen in FIG. 7. The circular paths of pin 56 about axis C1 and pin 66*b* about axis C2 simultaneously intersect plane a—a at points P1, P3 and R1, R2, respectively. As seen in FIG. 5, points R1 and R2 represent the locations of pin 66*b* in the extended and retracted null positions of pitman arm 65, respectively. It is thus apparent from FIGS. 3 and 7 that during the time pin 56 is revolving in a counterclockwise direction through arc A of approximately 120° from point P1 to point P3, pin 66*b*, carried by crank wheel assembly 60, is revolving from point R1 to point R2 in the same direction through 180° to move pitman arm 65 from the extended null to the retracted null position. Inasmuch as crank wheel assembly 60 is rotated through an additional 60° of arc, the rate of rotation of assembly 60 will be faster than that of the uniform speed of sprocket wheel 55. Likewise, while pin 56 revolves through arc B of approximately 240°, pin 66*b* revolves 180° returning pitman arm 65 from the retracted null to the extended null position, both pins 56 and 66*b* completing one cycle simultaneously. In revolving 60° of arc less than sprocket wheel 55, the rate of rotation of assembly 60 will be slower than the uniform speed of sprocket wheel 55.

With the rotary to reciprocating motion conversion drive mechanism 50 installed in machine 10 as hereinbefore described and shown in the drawings, the utility and operation of feeder will be apparent. Each cycle of operation of machine 10 may be considered to commence at the instant pitman arm 65 is brought to the extended null position shown in full lines in FIG. 3 and, as seen in full lines in FIG. 1, gripper 30 is brought to rest at the instant just prior to the beginning of the rapid forward stroke which is timed to the beginning of the dwell period of the multiple slides of the machine. The distance of travel of gripper 30 along track 21 determines the length of wire W being fed and may be controlled to close tolerances of ±0.0005 inch by stops adjustably located across track 21 against which gripper 30 abuts at the opposite ends of the travel distance thereof. For the purpose of clarity, these stops, which are conventional in the art, have been omitted from the showing in the drawings. The distance of travel of gripper 30 along track 21 is determined by the fixed spacial relationship of the pivot pins **26*b* and 26*c* with respect to the swing of lever arm 26 and by the adjustable distance between axis C2 and the location of the center of pivot pin 66*b* of assembly 66, this adjustable distance being ½ the distance between points R1 and R2. At the instant the cycle commences, cam 14, through roller 45*b*, has advanced slide 45 rearwardly rotating bell crank 43 counterclockwise, as viewed in FIG. 1, thereby carrying shift bar 41 toward track 21, shift bar 41 being constantly maintained in a parallel relation to track 21 by the coaction of bell crank 44 and alignment bar 42 of assembly 40. Shift bar 41, through slide follower 38, has pivoted bell crank 36 on pin 36*a* in a counterclockwise direction causing linkage 35 to elongate and project movable jaw 33 toward jaw 32 gripping wire W therebetween, linkage 35 being elongated when pivot pin 37*b* is brought into alignment with pins 36*a* and 37*a*, as shown in full lines in FIG. 1**.

Simultaneously with the multiple slides of machine 10 coming to rest for the dwell period, feeder 20 begins the feeding stroke, as hereinbefore described, as pivot pin 56 passes through point P1 and pin **66*b* passes through point R1, both points being on plane a—a. As crank wheel 64 rotates in a counterclockwise direction, pitman arm 65 pivots lever arm 26 toward the right, as seen in FIG. 3, and moves gripper 30 and wire W gripped thereby along track 21 in the same direction until pitman arm 65, after rotation of 180° by crank wheel assembly 60, reaches the retracted null position wherein pivot pin 66*b* again intersects plane a—a at point R2. This terminates the advance, feeding stroke of gripper 30 and is timed to the retraction of slide 45 by cam 14 to release wire W. The pivoting of bell crank 43 in a clockwise direction by the retraction of slide 45 moves shift bar 41 away from track 21 which in turn, through slide follower 38, pivots bell crank 36 clockwise displacing pivot pin 37*b* from alignment with pins 36*a* and 37*a*, shortening linkage 35 and retracting movable jaw 33 sufficiently to release wire W preparatory to the return stroke by gripper 30. It is thus clear that sprocket wheel 55 and the entire drive shaft system of machine 10 has rotated through an arc of 120° as indicated by arc A during the performance of the feeding stroke for an elapsed time for the dwell period of ⅓ of the cycle of machine 10. The multiple slides are timed to begin functioning upon the completion of the feed stroke and release of the wire W and has the remaining 240°, indicated as arc B, which translates in time to ⅔ of the cycle, available for cutting and forming the piece from the precisely measured length of wire fed by feeder 20. During this ⅔ of the cycle, pivot pin 56 in revolving from P3, through P4 to P1, as is clear from FIG. 7, rotates assembly 60 and returns pitman arm 65 from the retracted null to the extended null position bringing gripper 30** back to starting position for the next cycle.

In order for the rotary to reciprocating motion conversion drive mechanism 50 to function as hereinbefore described, the radii along which trackways **62*c* and 64*c* extend should be parallel to each other, as indicated in FIGS. 2 and 4. It will also be apparent that wheels 62 and 64, within the scope of the invention, may be constructed as a single wheel having trackways 62*c* and 64*c* formed therein back to back with slots 62*d* and 64*d*, respectively, thereof opening on opposite side surfaces of the wheel. For this arrangement the shaft equivalent to shaft 61 may be fixed to project from stub shaft 52 and bearing means provided for rotation of the single wheel on the fixed shaft. Also, crank wheel assembly 60 may be supported by another bearing block located adjacent to sprocket wheel 55. The two wheel construction with one wheel positioned on each side of bearing block 51** shown herein has been found to provide a balanced assembly minimizing stress and vibration.

The angle of inclination of axis b—b with respect to the vertical is primarily determined by the relative positioning of pivot pin **26*b*, which connects pitman arm 65 to lever arm 26, and axis C2 with respect to the horizontal plane. Thus, the positioning of axis C1 with respect to axis C2 along the inclined axis b—b herein shown renders optimum results based on the locations of pivot pin 26*b* and axis C2 shown in FIG. 3, namely, axis b—b being inclined away from arm 26 approximately 15° from the vertical plane, this being equivalent to the angle of inclination from the horizontal assumed by the longitudinal axis of pitman arm 65 when in the extended null position. For practical purposes, based on the arrangement of pivot pin 26*b* and axis C2 shown herein, axes C1 and C2 may be located along a vertical axis without noticeably affecting the desired 1 to 2 time ratio between the feed stroke and the return stroke in each cycle. In such an arrangement, points P2 and P4, as indicated in FIG. 7, would lie on the vertical axis, points P1 and P3 would lie on the horizontal plane while points R1 and R2 would remain on plane a—a inclined as indicated in FIG. 5. However, any deviation from the optimum perpendicular relation between the longitudinal axis of pitman arm 65** when in the extended null position and the axis b—b along which axes C1 and C2 lie should be limited to approximately 15° for satisfactory results.

From an understanding of the operation of drive mechanism 50 as hereinbefore described and as shown in the drawings, it will also be apparent that the proportional relationship of the distance D between axes C1 and C2 and the radial distance between axis C1 and pin 56 determines the value of arcs A and B. As seen in FIGS. 6 and 7, the radial distance between axis C1 and pin 56 of approximately twice the distance D achieves the desired arcs A and B of 120° and 240°, respectively.

The multiple slide machine equipped with a rotary to reciprocating motion conversion drive mechanism for the feeder herein disclosed is seen to achieve the several objects of the invention and to be well adapted to meet conditions of practical use. As various possible embodiments might be made of this invention, and as various changes might be made in the disclosed mechanisms, it is to be understood that all matters herein set forth or shown in the accompanying drawings are to be interpreted as illustrative and not in a limiting sense.

What is claimed is:

1. In a multiple slide machine having a device shaft rotating at a uniform rate and a reciprocating strip material feeder, said machine being driven to feed a measured length of said strip material and form one unit therefrom with each revolution of said drive shaft, a reciprocating motion conversion drive mechanism driven by said drive shaft in a one to one rotation ratio reciprocating said feeder in a rapid advance feed stroke and a slow return stroke of each cycle, said conversion drive mechanism comprising a drive wheel driven at said uniform rate on a first axis and having an eccentric pin spaced a first predetermined distance from said first axis, a driven wheel means rotating on a second axis spaced a second predetermined distance from said first axis, said driven wheel means having a radially extending slot engaged by said pin whereby said driven wheel means is rotated at a variable rate by said drive wheel, and a reciprocating pitman arm driven by said driven wheel means and linked to said feeder for effecting said rapid advance feed stroke and slow return stroke, said machine operation being timed for a dwell period during said advance stroke and for an operating period during said return stroke.

2. The multiple slide machine defined in claim 1, said first and second predetermined distances being approximately in the ratio of 2 to 1 providing a corresponding 2 to 1 ratio between the respective time intervals of said operating period and said dwell period.

3. A rotary to reciprocating motion conversion drive mechanism interposed between a main drive shaft of a multiple slide machine having a bed and a feeder having a reciprocating gripper for feeding strip material stock from a supply reel into the machine bed, said conversion drive mechanism comprising a drive wheel mounted for rotation on a first axis and being driven in a one to one rotation ratio at a uniform rate by said main drive shaft, a crank wheel assembly having a radially extending slot formed in a first side surface thereof, said assembly being mounted for rotation on a second axis parallel to and spaced a predetermined distance from said first axis, and a pitman arm pivotally mounted at one end to a predetermined eccentric location on a second side surface of said crank wheel assembly and connected at the other end to a linkage for reciprocating said gripper, said crank wheel assembly being driven by said drive wheel in a one to one rotation ratio at a variable rate of rotation by a pin mounted eccentrically with respect to said drive wheel to project therefrom and slidingly engage said assembly first side surface radial slot, said variable rate of rotation of said crank wheel assembly being synchronized to cause said pitman arm to advance said gripper during a relatively high rate of rotation and to return said gripper during a relatively low rate of rotation, and cam means driven by said drive shaft actuating said gripper to feed the strip material during said advance.

4. The rotary to reciprocating motion conversion drive mechanism defined in claim 3 in which said first and second side surfaces are formed as opposite sides of a single wheel.

5. The rotary to reciprocating motion conversion drive mechanism defined in claim 4 including a bearing block support therefor having a stub shaft extending from one side thereof, said drive wheel being mounted to turn on said stub shaft on said first axis, a crank wheel shaft as said rotation mounting for said crank wheel assembly on which said single wheel rotates on said second axis, said stub shaft being diametrically sized to fixedly support said crank wheel shaft to project therefrom.

6. The rotary to reciprocating motion conversion drive mechanism defined in claim 3 including a bearing block support therefor having a stub shaft extending from one side thereof, said drive wheel being mounted to turn on said stub shaft on said first axis, said crank wheel assembly including a crank wheel shaft as said rotation mounting, said stub shaft being diametrically sized to journal said crank wheel shaft therein for rotation with respect thereto on said second axis at said predetermined distance from said first axis.

7. The rotary to reciprocating motion conversion drive mechanism defined in claim 6 in which said crank wheel assembly includes a first wheel having said first side surface and a second wheel having said second side surface, said first and second wheels being mounted on said crank wheel shaft to turn therewith, said second wheel being located on a side of said bearing block support opposite said stub shaft.

8. The rotary to reciprocating motion conversion drive mechanism defined in claim 3 in which the multiple slides of said machine are actuated from said main drive shaft to complete one cycle with each rotation of the drive shaft and are synchronized to said conversion drive mechanism to remain at rest in a dwell period during said gripper advance and to operate on said fed strip material during said gripper return.

9. The rotary to reciprocating motion conversion drive mechanism defined in claim 8 in which said crank wheel assembly synchronization is such that the elapsed time of said gripper return is twice the elapsed time of said gripper advance.

10. The rotary to reciprocating motion conversion drive mechanism defined in claim 9 including a bearing block support therefor having a stub shaft extending from one side thereof, said drive wheel being mounted to turn on said stub shaft on said first axis, said crank wheel assembly including a crank wheel shaft as said rotation mounting and a first and second wheel mounted on said crank wheel shaft to turn therewith, said stub shaft being diametrically sized to include said crank wheel shaft at said predetermined distance from said first axis, said crank wheel shaft being journaled to extend through said stub shaft and bearing block support, said first wheel being located adjacent said stub shaft for said pin and slot engagement, said second wheel being located on the side of said bearing block support opposite said stub shaft.

11. The rotary to reciprocating motion conversion drive mechanism defined in claim 3 in which the radial distance of said eccentric pin from said first axis is approximately twice said predetermined distance between said first and second axes thereby providing a 1 to 2 time ratio between said advance stroke and said return stroke.

12. The rotary to reciprocating motion conversion drive mechanism defined in claim 3 in which said eccentric location of said pitman arm mounting is adjustable along a radius of said second side surface to adjust the length of throw of said gripper, the radius of said first side surface slot and said second side surface radius of adjustability being parallel to each other.

* * * * *